US009895000B2

(12) United States Patent
Hassman

(10) Patent No.: US 9,895,000 B2
(45) Date of Patent: Feb. 20, 2018

(54) CHAIR WITH GRAVITY FEED BEVERAGE CAN DISPENSER

(71) Applicant: Ellen Hassman, Hollywood, FL (US)

(72) Inventor: Ellen Hassman, Hollywood, FL (US)

( * ) Notice: Subject to any disclaimer, the term of this patent is extended or adjusted under 35 U.S.C. 154(b) by 0 days.

(21) Appl. No.: 15/452,172

(22) Filed: Mar. 7, 2017

(65) Prior Publication Data

US 2017/0258235 A1 Sep. 14, 2017

Related U.S. Application Data

(60) Provisional application No. 62/389,723, filed on Mar. 8, 2016.

(51) Int. Cl.
*A47C 7/62* (2006.01)
*G07F 9/10* (2006.01)

(52) U.S. Cl.
CPC ..... *A47C 7/62* (2013.01); *G07F 9/105* (2013.01)

(58) Field of Classification Search
CPC .. A47C 7/62; A47C 7/742; A47C 1/02; G07F 9/105
USPC ..... 297/188.17, 188.16, 188.14, 188.19
See application file for complete search history.

(56) References Cited

U.S. PATENT DOCUMENTS

| | | | | |
|---|---|---|---|---|
| 2,494,838 A * | 1/1950 | Slaughter | A47C 7/70 | 297/145 |
| 3,136,578 A * | 6/1964 | Tihovici | A47C 7/72 | 297/188.16 |
| 4,191,420 A * | 3/1980 | Fassett | A01K 97/22 | 297/17 |
| 4,719,764 A * | 1/1988 | Cook | F25D 11/00 | 297/180.14 |
| 5,106,153 A * | 4/1992 | Durling | A47C 7/62 | 297/135 |
| 5,628,544 A * | 5/1997 | Goodman | A47C 1/14 | 190/8 |
| 6,106,058 A * | 8/2000 | Sur | A47C 7/54 | 297/188.14 |
| 2009/0212606 A1* | 8/2009 | Bunch | A47C 1/143 | 297/188.14 |

* cited by examiner

*Primary Examiner* — Milton Nelson, Jr.
(74) *Attorney, Agent, or Firm* — Robert M. Downey, P.A.

(57) ABSTRACT

A chair includes a seat base, a back rest, left and right chair arm structures on opposite sides of the seat base, and a dispenser housing fitted within one of the chair arm structures. A cooler is removably received within an interior chamber of the dispenser housing and is structured to be filled with ice or frozen gel packs. A downwardly angled rack within the interior chamber provides a path that is directed at least partially around the cooler. The rack holds an arrangement of adjacently positioned beverage cans that are able to roll along the path by gravity assist while also being chilled by the cooler. A sliding drawer below the interior chamber includes a pocket for receiving a lowermost beverage can from the rack. The drawer pulls out from the front of the chair to dispense a single beverage can while the remaining cans advance one position.

18 Claims, 6 Drawing Sheets

CHAIR WITH GRAVITY FEED BEVERAGE CAN DISPENSER

This non-provisional patent application is based on provisional patent application Ser. No. 62/389,723 filed Mar. 8, 2016.

BACKGROUND OF THE INVENTION

Field of the Invention

The present invention is directed to a chair that includes a dispenser for dispensing containers and, more particularly, to a chair including a built-in dispenser that dispenses chilled beverage containers on demand, and wherein the dispenser is adapted to hold an arrangement of beverage containers that are progressively advanced and individually released from the dispenser by gravity feed.

Discussion of the Related Art

When seated for an extended period of time, such as when watching a movie or sporting event on television, it is often desirous to consume food and beverages. In particular, many sports enthusiasts enjoy consuming soft drinks or beer while watching a sporting event, such as a football game or baseball game on television. During the course of the event, a person may need to make numerous trips to the kitchen in order to retrieve another beverage after the previous one has been consumed. This can be inconvenient, especially if a person is watching an exciting movie or sporting event, wherein the need to get up and leave the room may cause them to miss a critical moment during the event.

Accordingly, it is more convenient to have a supply of chilled beverages nearby a person's seating area so that they can easily retrieve a cold beverage on demand. However, placing a traditional cooler or refrigerator in the middle of a living area is not very attractive or desirable.

Accordingly, there is a need for a comfortable chair, such as a recliner chair, that includes a built-in beverage dispenser that allows a user to retrieve a chilled beverage, on demand, without having to leave the comfort of their seat while viewing an event or while engaged in a conversation.

Objects and Advantages of the Invention

Considering the forgoing, it is a primary object of the present invention to provide a chair that includes a built-in beverage dispenser that is structured to dispense chilled beverage containers on demand.

It is a further object of the present invention to provide a chair that includes a built-in beverage dispenser that is structured to hold an arrangement of beverage containers, and wherein the beverage containers are progressively moved in sequence along a rack for delivery to a dispensing drawer that dispenses an individual one of the beverage containers to the user.

It is still a further object of the present invention to provide a chair that includes a built-in beverage dispenser that is structured to hold an arrangement of beverage containers and a cooler for cooling the beverage containers.

It is still a further object of the present invention to provide a chair that includes a built-in beverage dispenser that includes a removable cooler that is structured to be filled with ice or frozen gel packs It is still a further object of the present invention to provide a chair that includes a built-in beverage dispenser that holds an arrangement of beverage containers that are progressively moved along a path by gravity feed, with a lowermost one of the beverage containers along the path being deposited within a dispensing drawer for delivery to the user on demand.

It is still a further object of the present invention to provide a chair that includes a built-in beverage dispenser that dispenses beverage cans with the use of a gravity feed system, while requiring no electric power or complex moving parts.

It is still a further object of the present invention to provide a chair that includes a built-in beverage dispenser, as set forth above, and wherein the chair is a recliner chair.

It is still a further object of the present invention to provide a chair that includes a built-in beverage dispenser, as set forth above, and wherein the chair is made to include a pebble leather material resembling a football.

These and other objects and advantages of the present invention are more readily apparent with reference to the following detailed description taken in conjunction with the accompanying drawings.

SUMMARY OF THE INVENTION

The present invention is directed to a chair that includes a seat base, a back rest, left and right chair arm structures on opposite sides of the seat base, and a dispenser housing fitted within one of the chair arm structures. A cooler is removably received within the interior chamber of the dispenser housing and is structured to be filled with ice or frozen gel packs. A downwardly angled rack within the interior chamber provides a path that is directed at least partially around the cooler. The rack holds an arrangement of adjacently positioned beverage cans that are able to roll along the path by gravity assist while being chilled by the cooler. A sliding drawer below the interior chamber includes a pocket for receiving a lowermost beverage can from the rack. The drawer pulls out from the front of the chair to dispense a single beverage can.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
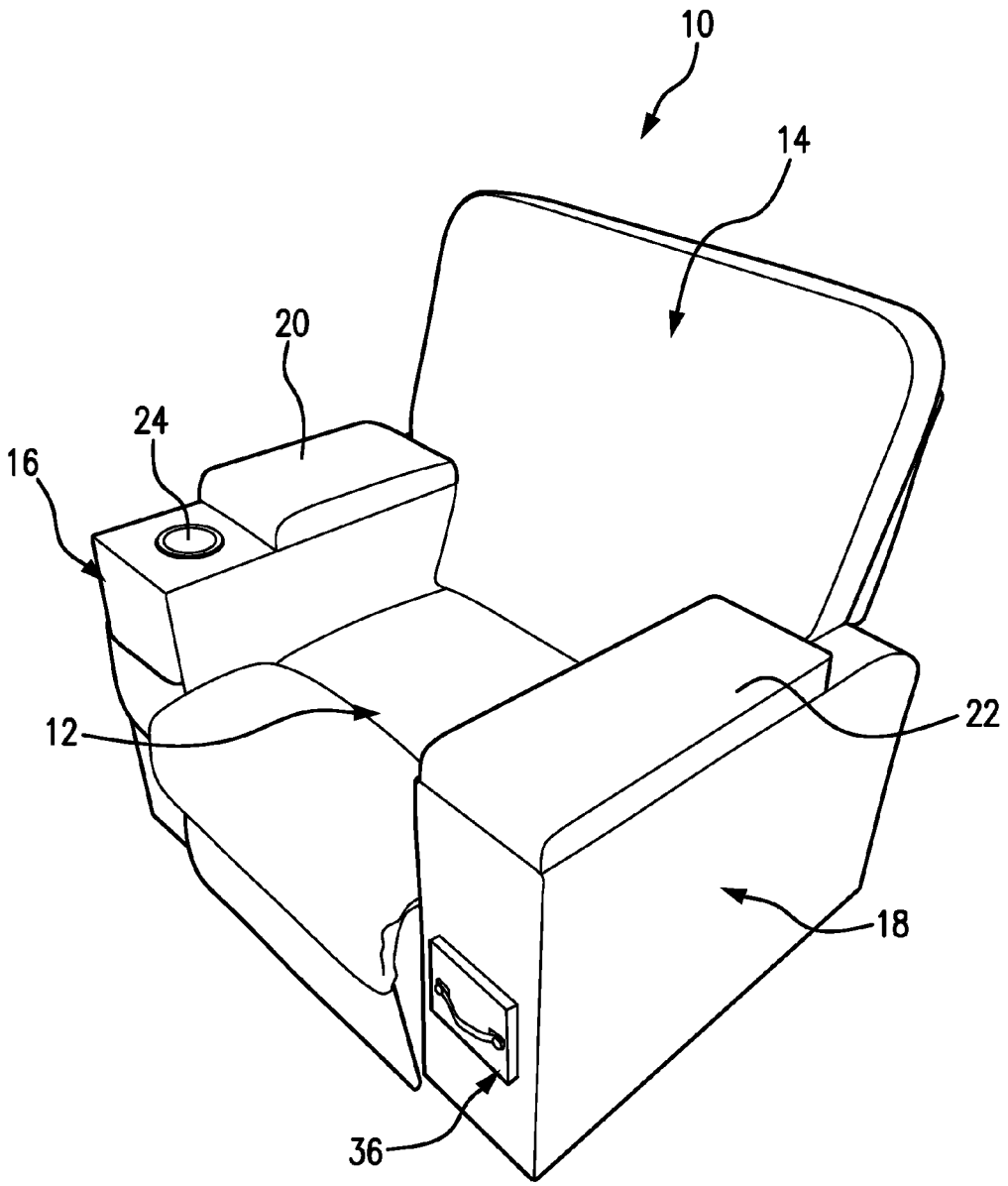
FIG. 1 is a front top perspective view of the chair with automatic gravity feed beer dispenser of the present invention.
Figure 2:
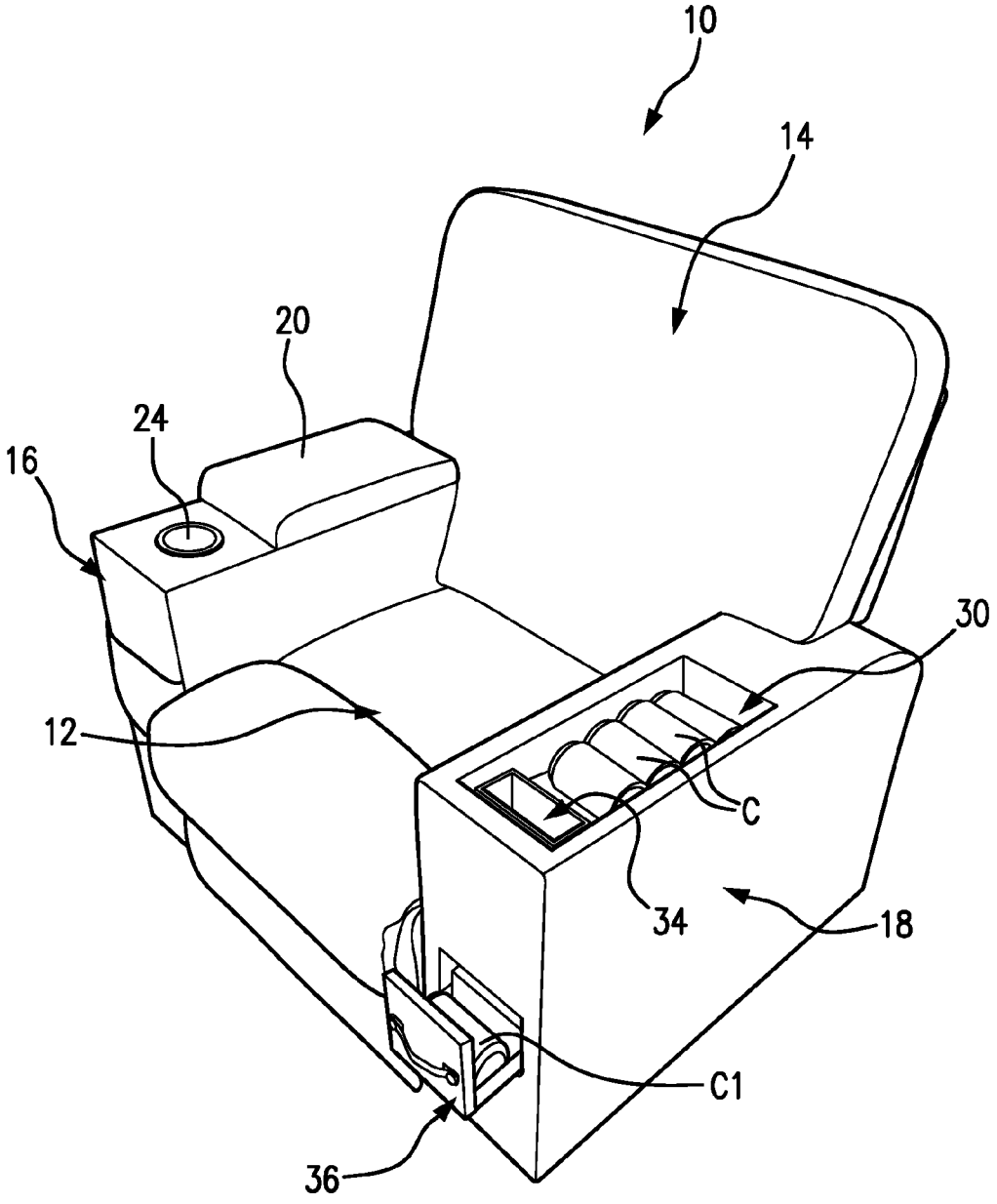
FIG. 2 is a front top perspective view showing an arm rest cover removed from a left chair arm structure to reveal an interior chamber with a cooler and an arrangement of beverage cans and a dispensing drawer pulled out from a bottom of the chair arm structure to dispense a single beverage can.
Figure 3:
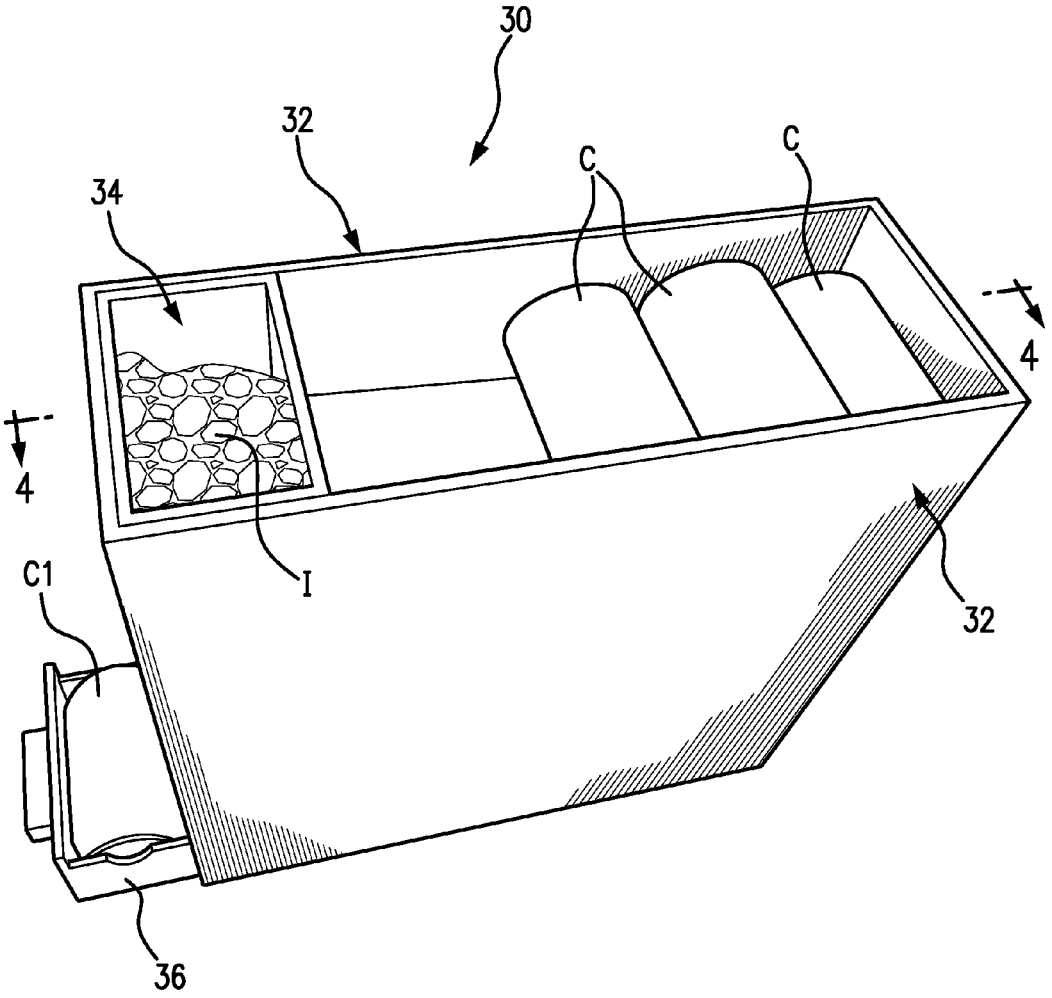
FIG. 3 is an isolated perspective view showing a dispenser housing that has been removed from the left chair arm structure, and including the ice filled cooler received within the interior chamber of the dispenser housing and arrangement of beverage cans within the dispenser housing, and the bottom drawer pulled out to dispense a single beverage can.
Figure 4:
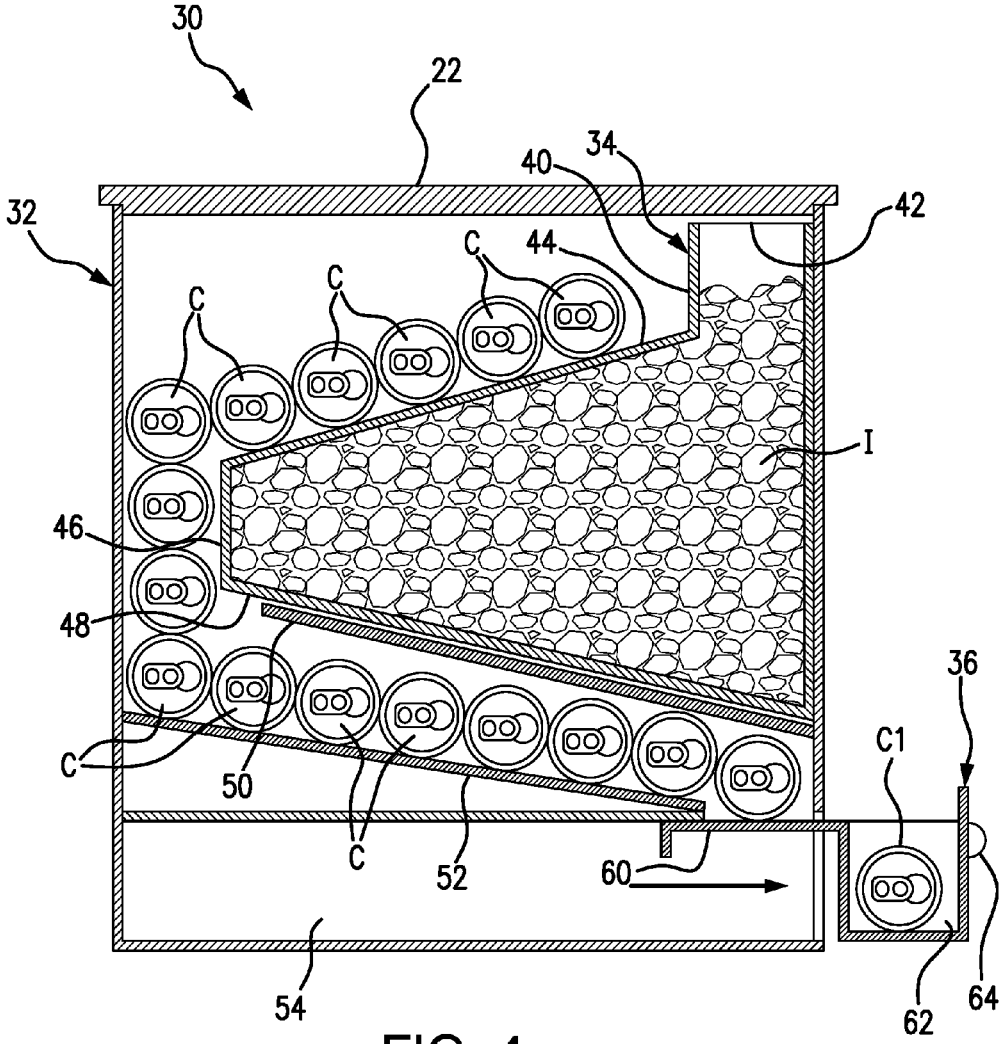
FIG. 4 is a cross-sectional view taken along the line indicated by the arrows 4-4 in FIG. 3 showing the arrangement of beverage cans positioned along a dispensing path that travels about the ice filled cooler, and with the bottom drawer pulled out to dispense a single beverage can.
Figure 5:
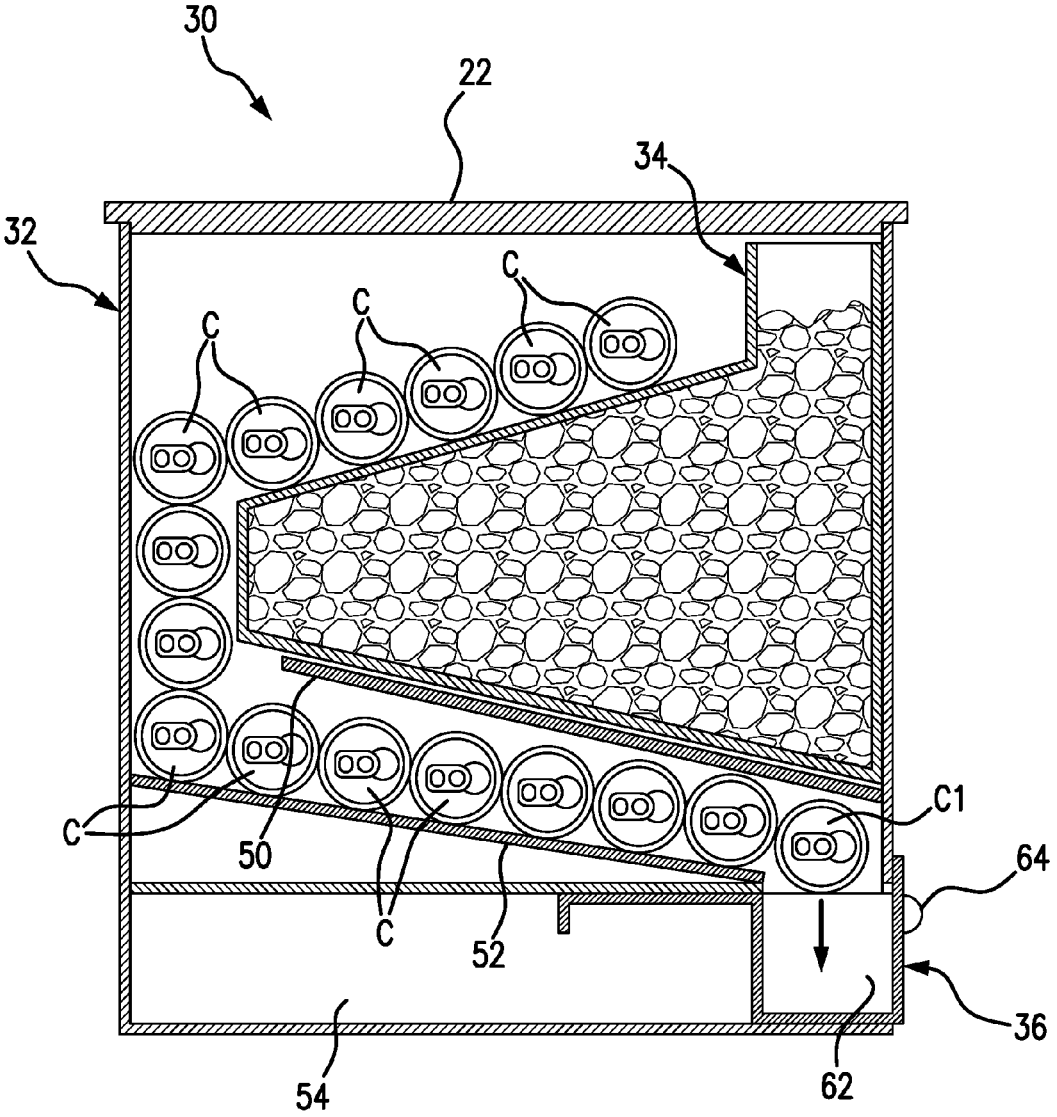
FIG. 5 is a cross-sectional view similar to FIG. 4 and showing the bottom drawer closed to allow a next successive beverage can at a bottom of the rack to be delivered into the pocket of the drawer.

Referring to the several views of the drawings, and initially FIGS. 1-2, the chair with an automatic gravity feed beverage dispenser is shown and is generally indicated as 10. The chair 10 includes a seat base 12, a back rest 14 and opposite chair arm structures 16 and 18 on opposite sides of the seat base 12, as clearly illustrated in FIGS. 1 and 2. The right chair arm structure includes a top arm rest 20 which may be cushioned for comfort. A beverage holder 24 may also be provided on the top of the right chair arm structure 16. The left chair arm structure 18 includes an arm rest 22 which also may be padded for purposes of comfort. The arm rest 22 is removable to reveal a beverage dispenser assembly 30 that is built-in to the interior of the left chair arm structure 18, as shown in FIG. 2.

The beverage dispenser assembly 30 includes a dispenser housing 32, as seen in FIGS. 3-6, which may be made to be easily removed through the open top of the left chair arm structure 18 (see FIG. 2). The dispenser housing 32 has an interior chamber that is adapted to receive a cooler 34. When the cooler 34 is fitted within the interior chamber of the dispenser housing, a rack is formed to hold an arrangement of beverage containers C. In a preferred embodiment, the beverage containers C are aluminum cans and in at least one embodiment, the aluminum can beverage containers C are beer cans. In another embodiment, the beverage containers C are soft drink cans. The rack is structured to hold the arrangement of beverage containers C in a downwardly directed path that allows the containers C to move in sequence, along the path with a lowermost one of the containers C1 being deposited within a pocket 62 of the drawer 36 that is pulled out from the front of the chair arm structure 18 to deliver the individual beverage container C1 to a person seated in the chair.

Figure 6:
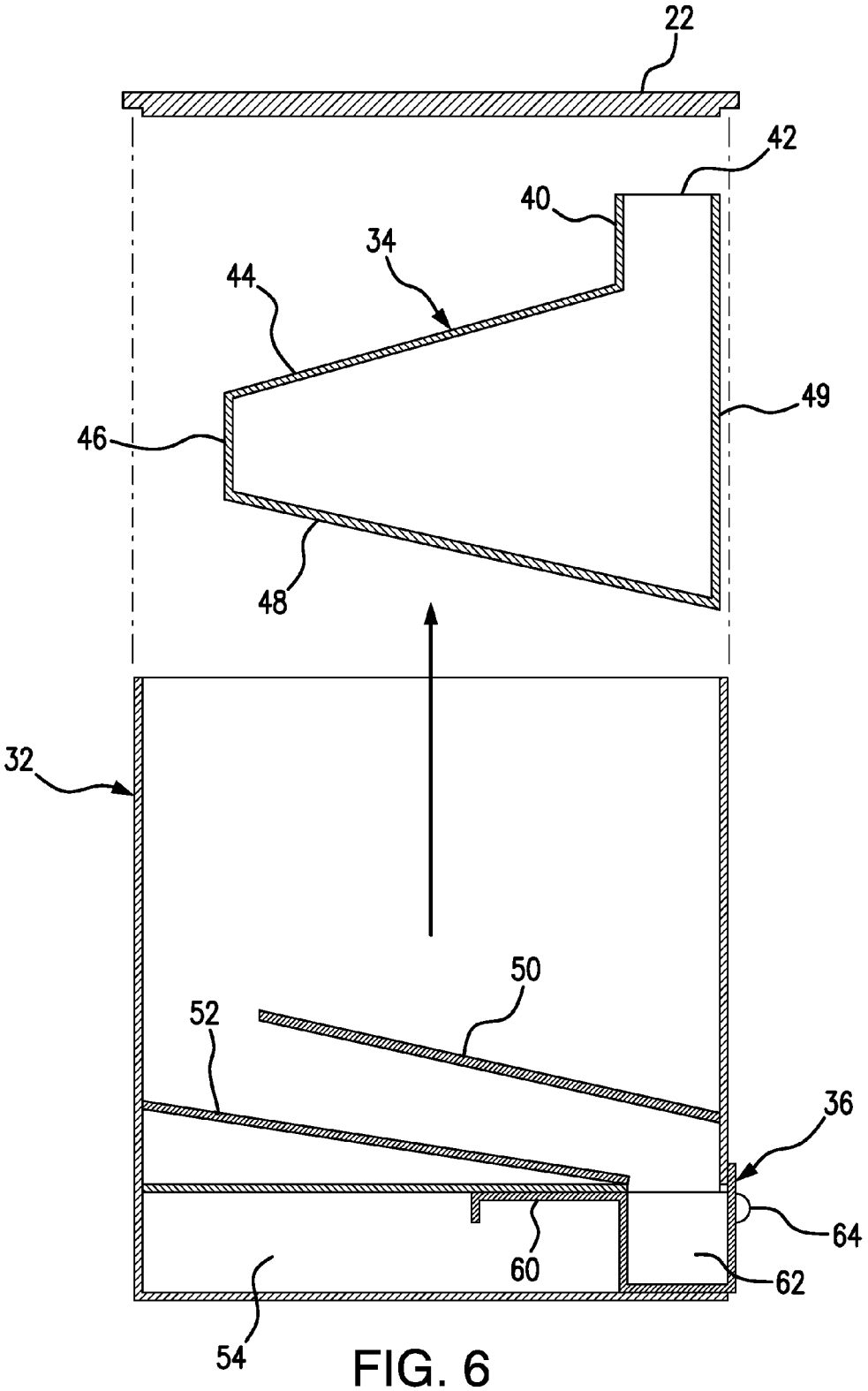
FIG. 6 is a partially exploded cross-sectional view showing the top arm rest cover removed and the cooler pulled out from the dispenser housing.

The cooler is preferably made to be easily removable from the interior chamber of the dispenser housing 32, as seen in FIG. 6. The cooler 34 includes a top neck portion 40 that extends up to an open top 42 that allows the cooler to be easily filled with ice I (e.g., crushed ice or ice cubes) or frozen gel packs. The cooler 34 further includes a downwardly sloped top wall 44, a vertical inner wall 46 and a downwardly sloped bottom wall 48. An opposite vertical wall 49 extends from the open top 42 to the lowermost point of the bottom wall 48 and is normally positioned in engagement with a front inner surface of the front wall of the dispenser housing. The bottom sloped wall 48 of the cooler seats against an angled plate member 50 that is fitted within the interior chamber of the dispenser housing 32. The angled plate member 50 holds the cooler at a desired position within the interior chamber of the dispenser housing 32 in order to form the rack which holds the arrangement of beverage containers C in the downwardly directed path, as clearly seen in FIGS. 4 and 5. A bottom sloped floor 52 is also fitted within the interior of the dispenser housing 32 in generally parallel relation to the downwardly angled plate member 50 for forming the final dispensing chute that delivers the beverage containers C to the drawer 36. Specifically, when the drawer 36 is closed (i.e., pushed all the way in to the bottom chamber 54 of the dispenser housing 32), the pocket 62 of the drawer is aligned with the lowermost beverage container Cl along the path so that the lowermost container C1 drops into the drawer pocket 62. When the drawer 36 is pulled out, by grasping the handle 64, a floor 60 of the drawer 36 holds the next successive lowermost beverage container C in position to be dropped into the pocket 62 when the delivered beverage container C1 is removed from the pocket 62 and the drawer is closed. Once the drawer 36 is closed, the pocket 62 moves in position below the next successive beverage container along the delivery path, allowing the lowermost one of the containers Cl to drop into the pocket 62 for delivery to the user.

While the present invention has been shown and described in accordance with several preferred and practical embodiments, it is recognized that departures from the instant disclosure are fully contemplated within the spirit and scope of the present invention which is not to be limited except as defined in the following claims.

What is claimed is:

1. A chair comprising:

a seat base, a back rest, a left chair arm structure and a right chair arm structure;

a dispenser assembly within the chair and including an interior chamber;

a cooler structured and disposed for removable receipt within the interior chamber, and the cooler being further structured for holding ice or another frozen substance;

a rack within the interior chamber and at least partially surrounding the cooler, and the rack being structured and disposed for holding an arrangement of adjacently positioned containers in a downwardly directed path to allow the adjacently positioned containers to sequentially move along the path by gravity assist, and the cooler being positioned for cooling the containers held in the rack; and a dispenser mechanism in communication with the arrangement of containers in the rack, and the dispenser mechanism being structured and disposed to receive an individual one of the containers for delivery to a user upon operating the dispenser mechanism.

2. The chair as recited in claim 1 wherein the chair is a recliner chair.

3. The chair as recited in claim 1 wherein the cooler is formed, structured and configured to form at least a portion of the rack when the cooler is received within the interior chamber of the dispenser assembly.

4. The chair as recited in claim 3 wherein the cooler includes an open top to allow the ice or other frozen substance to be filled within the cooler.

5. The chair as recited in claim 1 wherein the dispenser mechanism is a sliding drawer that pulls out from the chair to deliver the individual one of the containers to the user.

6. The chair as recited in claim 5 wherein the drawer includes a pocket that is sized, structured and configured to receive the individual one of the containers therein when the drawer is moved into the chair to a closed position.

7. The chair as recited in claim 1 wherein the dispenser assembly is within at least one of the left and right chair arm structures.

8. The chair as recited in claim 7 further comprising an arm rest adapter for removable placement over an open top of the interior chamber of the dispenser assembly.

9. The chair as recited in claim 8 wherein the arm rest is cushioned.

10. A chair comprising:

a seat base, a left chair arm structure and a right chair arm structure;

a dispenser assembly within the chair and including an interior chamber;

a cooler structured and disposed for removable receipt within the interior chamber, and the cooler being further structured for holding ice or another frozen substance;

a rack within the interior chamber and at least partially surrounding the cooler, and the rack being structured and disposed for holding an arrangement of adjacently positioned containers in a downwardly directed path to allow the adjacently positioned containers to sequentially move along the path by gravity assist, and the cooler being positioned for cooling the containers held in the rack; and a dispenser mechanism in communication with the arrangement of containers in the rack, and the dispenser mechanism being structured and disposed to receive an individual one of the containers for delivery to a user upon operating the dispenser mechanism.

11. The chair as recited in claim 10 wherein the chair is a recliner chair.

12. The chair as recited in claim 10 wherein the cooler is formed, structured and configured to form at least a portion of the rack when the cooler is received within the interior chamber of the dispenser assembly.

13. The chair as recited in claim 12 wherein the cooler includes an open top to allow the ice or other frozen substance to be filled within the cooler.

14. The chair as recited in claim 10 wherein the dispenser mechanism is a sliding drawer that pulls out from the chair to deliver the individual one of the containers to the user.

15. The chair as recited in claim 14 wherein the drawer includes a pocket that is sized, structured and configured to receive the individual one of the containers therein when the drawer is moved into the chair to a closed position.

16. The chair as recited in claim 10 wherein the dispenser assembly is within at least one of the left and right chair arm structures.

17. The chair as recited in claim 16 further comprising an arm rest adapter for removable placement over an open top of the interior chamber of the dispenser assembly.

18. The chair as recited in claim 17 wherein the arm rest is cushioned.

* * * * *